US012076776B2

(12) United States Patent
Okada et al.

(10) Patent No.: US 12,076,776 B2
(45) Date of Patent: Sep. 3, 2024

(54) PRESS BRAKE AND METHOD OF OPERATING PRESS BRAKE

(71) Applicants: Kawasaki Jukogyo Kabushiki Kaisha, Kobe (JP); LVD Company nv, Gullegem (BE)

(72) Inventors: Hideki Okada, Kobe (JP); Hiroki Oribe, Kobe (JP); Hitoshi Yano, Kobe (JP); Kristof Tyvaert, Gullegem (BE); Alexander Cornelus, Gullegem (BE)

(73) Assignees: KAWASAKI JUKOGYO KABUSHIKI KAISHA, Kobe (JP); LVD COMPANY NV, Gullegem (BE)

( * ) Notice: Subject to any disclaimer, the term of this patent is extended or adjusted under 35 U.S.C. 154(b) by 331 days.

(21) Appl. No.: 17/563,087

(22) Filed: Dec. 28, 2021

(65) Prior Publication Data

US 2022/0118495 A1 Apr. 21, 2022

Related U.S. Application Data

(63) Continuation of application No. PCT/JP2020/025402, filed on Jun. 26, 2020.

(30) Foreign Application Priority Data

Jun. 28, 2019 (JP) ..... 2019-122092

(51) Int. Cl.
*B21D 5/02* (2006.01)

(52) U.S. Cl.
CPC ..... *B21D 5/0209* (2013.01); *B21D 5/0272* (2013.01); *B21D 5/0281* (2013.01)

(58) Field of Classification Search
CPC .... B21D 5/002; B21D 5/0209; B21D 5/0272; B21D 5/0281; B21D 11/20; B30B 15/048
(Continued)

(56) References Cited

U.S. PATENT DOCUMENTS 2,781,849 A * 2/1957 Bladergroen ..... B21D 31/02 29/423
3,263,319 A * 8/1966 Tifft ..... B21D 33/00 72/347

(Continued)

FOREIGN PATENT DOCUMENTS

DE 24 61 538 A1 7/1975
GB 1489257 A 10/1977

(Continued)

OTHER PUBLICATIONS

JP 03-47634A, Taura et al. Feb. 1991.*

*Primary Examiner* — Edward T Tolan
(74) *Attorney, Agent, or Firm* — XSENSUS LLP

(57) ABSTRACT

There is provided a press brake that can improve forming accuracy in partial bending. A press brake includes: a conveying mechanism that intermittently conveys a workpiece; a die including a pair of shoulder portions and a groove portion located between the pair of shoulder portions, the pair of shoulder portions being arranged away from each other in a conveying direction of the workpiece and supporting a rear surface of the workpiece; a backup plate that extends on the pair of shoulder portions, covers the groove portion, and is interposed between the die and the workpiece; and a punch that moves relative to the die so as to approach the die each time the conveying mechanism stops conveying the workpiece and presses the workpiece so as to bend the workpiece within an elastic deformation region of the backup plate.

4 Claims, 4 Drawing Sheets

(58) Field of Classification Search
USPC ..... 72/363, 465.1, 466.8; 269/311, 314
See application file for complete search history.

(56) References Cited

U.S. PATENT DOCUMENTS

| | | | | |
|---|---|---|---|---|
| 3,566,661 | A * | 3/1971 | McCafferty et al. | B21D 5/08 72/220 |
| 3,979,815 | A * | 9/1976 | Nakanose | B21D 26/055 29/DIG. 45 |
| 5,542,282 | A * | 8/1996 | Muldner | B21D 28/00 72/414 |
| 5,887,475 | A * | 3/1999 | Muldner | B21D 5/02 72/389.3 |
| 5,956,991 | A * | 9/1999 | Tseng | B21D 11/10 72/213 |
| 6,865,917 | B2 * | 3/2005 | Golovashchenko | B21D 39/021 72/466.8 |
| 8,733,145 | B1 * | 5/2014 | Chada, Jr. | B21C 37/155 72/368 |
| 9,664,493 | B2 * | 5/2017 | Angerer | B21D 5/02 |
| 2016/0121382 | A1 | 5/2016 | Maeda | |
| 2020/0038932 | A1 * | 2/2020 | Kato | B21D 35/007 |

FOREIGN PATENT DOCUMENTS

| | | | |
|---|---|---|---|
| JP | 3236310 | B2 | 12/2001 |
| JP | 2014-004606 | A | 1/2014 |
| JP | 2016-59935 | A | 4/2016 |
| JP | 2018-114527 | A | 7/2018 |
| WO | 2018/143302 | A1 | 8/2018 |

* cited by examiner

PRESS BRAKE AND METHOD OF OPERATING PRESS BRAKE

CROSS-REFERENCE TO RELATED APPLICATIONS

The present application is a bypass continuation of PCT Filing PCT/JP2020/025402, filed Jun. 26, 2020, which claims priority to JP 2019-122092, filed Jun. 28, 2019, both of which are incorporated by reference in their entirety.

BACKGROUND OF THE INVENTION

1. Field of the Invention

The present disclosure relates to a press brake that subjects a workpiece to bending, and a method of operating the press brake.

2. Description of the Related Art

In case subjecting a workpiece to multistage bending with a press brake, a so-called partial bending method that is a typical air bending method, is used. The partial bending method is a method of bending the workpiece by a punch in a state where the workpiece is not brought into contact with the bottom of a groove of a die, and a rear surface of the workpiece floats in the groove. As other methods, there are a bottoming method, a coining method, WING BEND™, and the like. According to these methods, the workpiece is brought into contact with the bottom of the die. As another method in which the workpiece is brought into contact with the bottom of the die, a method of performing forming by using a urethane die is also known.

SUMMARY

An object of the present disclosure is to provide a press brake that can improve forming accuracy of a workpiece having a thickness that changes in a longitudinal direction, and a method of operating the press brake.

A press brake according to the present application is a press brake that performs bending with respect to a workpiece by a die and a punch. The press brake includes: a die including a pair of shoulder portions and a groove portion located between the pair of shoulder portions, the pair of shoulder portions being arranged away from each other in a conveying direction of a workpiece and supporting a rear surface of the workpiece; a backup plate that extends on the pair of shoulder portions, covers the groove portion, and is interposed between the die and the workpiece; and a punch that moves relative to the die and presses the workpiece within an elastic deformation region of the backup plate to bend the workpiece.

BRIEF DESCRIPTION OF THE DRAWINGS

FIG. 3A shows that an edge portion of a workpiece is subjected to bending by using a counterforce applying mechanism. FIG. 3B shows that a non-edge portion of the workpiece is subjected to the bending without using the counterforce applying mechanism.

DESCRIPTION OF THE PREFERRED EMBODIMENTS

Figure 1:
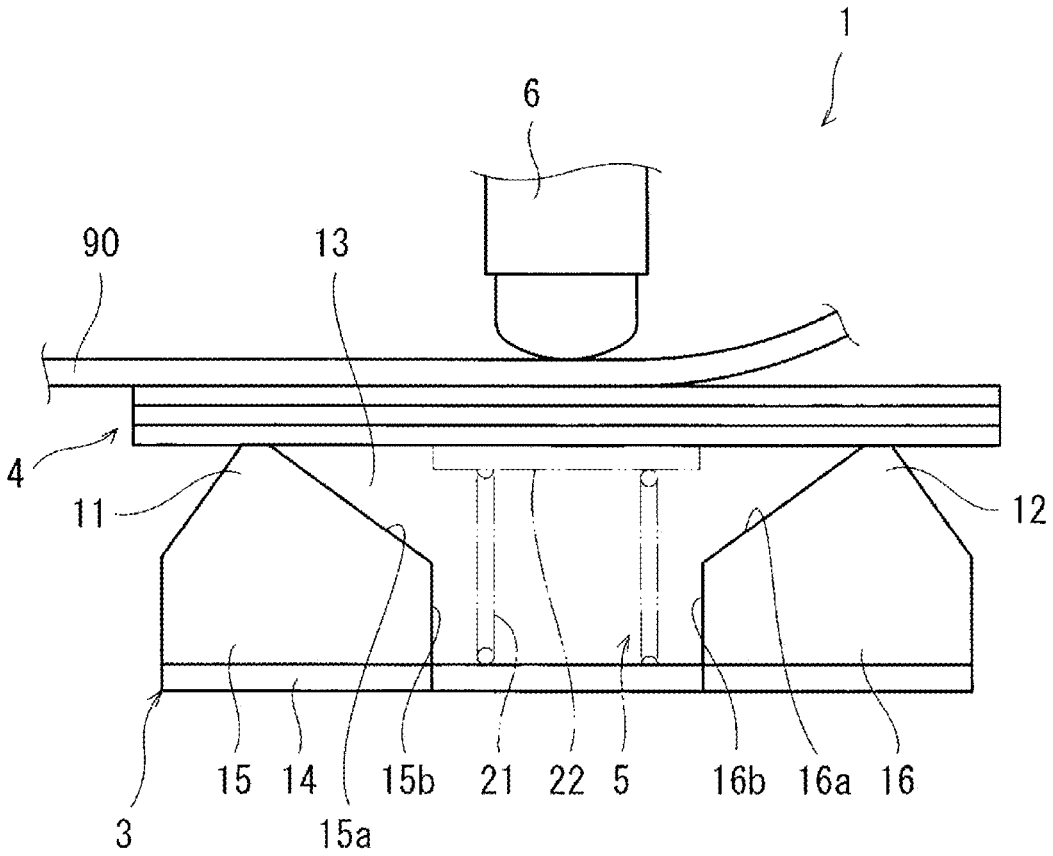
FIG. 1 is a side view of a press brake according to Embodiment 1.

Hereinafter, embodiments will be described with reference to the drawings. In the drawings, the same reference signs are used for the same or corresponding components, and the repetition of the same detailed explanation is avoided.

Embodiment 1

Figure 2:
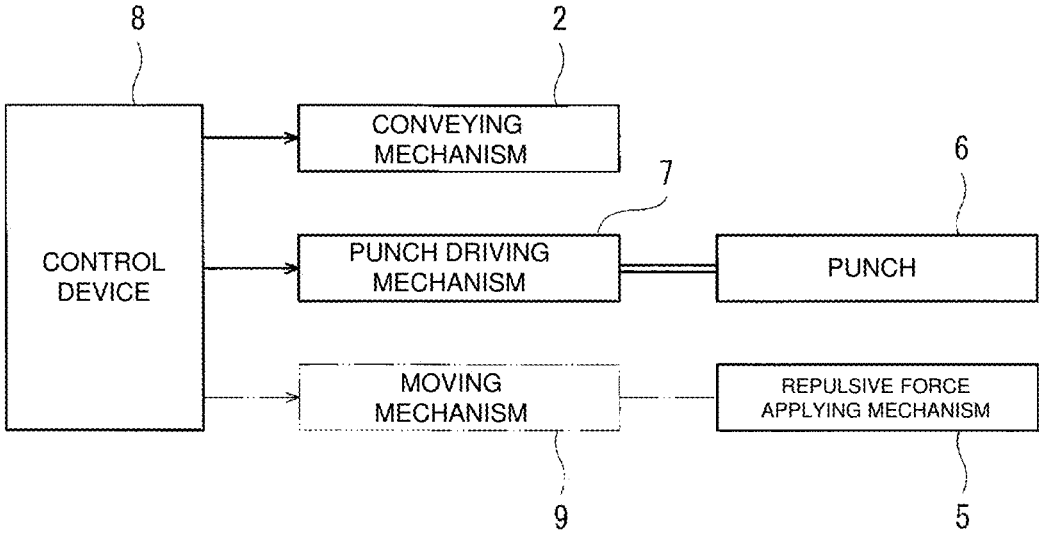
FIG. 2 is a block diagram showing the press brake according to Embodiment 1.

FIG. 1 is a side view of a press brake 1 according to Embodiment 1. FIG. 2 is a block diagram showing the press brake 1 according to Embodiment 1. The press brake 1 shown in FIGS. 1 and 2 can perform multistage bending with respect to a plate-shaped workpiece 90 that is long and wide. A circular tube body, such as a skin of an aircraft body portion, which is relatively large in diameter can be manufactured from the workpieces 90. The press brake 1 includes a conveying mechanism 2, a die 3, a backup plate 4, a counterforce applying mechanism 5, a punch 6, a punch driving mechanism 7, and a control device 8. The feeding mechanism 2 is, in other words, a feeding device 2. The counterforce applying mechanism 5 is, in other words, a counterforce applying device 5. The punch driving mechanism 7 is, in other words, punch driving device 7.

The conveying mechanism 2 intermittently conveys the workpiece 90. A specific configuration of the conveying mechanism 2 is not especially limited. The conveying mechanism 2 may be comprised by a conveyor, a robot including a hand at a tip of a robot arm, or the like.

The die 3 includes a pair of shoulder portions 11 and 12 and a groove portion 13 located between the pair of shoulder portions 11 and 12. The pair of shoulder portions 11 and 12 are arranged away from each other in a conveying direction of the workpiece 90 and support a rear surface of the workpiece 90. In the present embodiment, as one mere example, the die 3 includes a base plate 14 and a pair of lower die elements 15 and 16 standing on the base plate 14. The lower die elements 15 and 16 are arranged away from each other in the conveying direction, and top portions of the lower die elements 15 and 16 constitute the shoulder portions 11 and 12, respectively. The lower die elements 15 and 16 include opposing surfaces opposed to each other, and these opposing surfaces include tapered portions 15*a* and 16*a* that are inclined so as to approach each other in the conveying direction as the tapered portions 15*a* and 16*a* extend downward from the respective top portions. The tapered portions 15*a* and 16*a* define the groove portion 13, and the groove portion 13 has a substantially V-shaped section. The opposing surfaces include vertical portions 15*b* and 16*b* that are continuous from lower ends of the tapered portions 15*a* and 16*a*, extend vertically downward, and are opposed to each other in parallel. As described above, the die 3 shown in FIG. 1 is one example and is not limited to this configuration. For example, in the die 3, the base plate 14 and the lower die elements 15 and 16 may be integrated as a single member. The lower die elements 15 and 16 may not include the tapered portions 15*a* and 16*a*. The lower die elements 15 and 16 may not include the vertical portions 15*b* and 16*b*. The shape of the die 3 can be suitably set.

The backup plate 4 extends between the pair of shoulder portions 11 and 12 and covers the groove portion 13. The backup plate 4 includes a laminated structure in which thin plates are stacked on each other. With this, even if the workpiece 90 is pressed by the punch 6 to plastically deform, the backup plate 4 does not plastically deform but merely deforms within an elastic deformation region. The material of each thin plate is not especially limited, and each thin plate may be made of a metal material having a relatively large elastic deformation region. One example of the material of each thin plate is spring steel. Moreover, the number of thin plates stacked is not especially limited and may be at least two or more or may be ten or more. To secure the larger elastic deformation region of the backup plate 4, it is preferable that the thin plates be merely stacked on each other without being adhered to each other with an adhesive. However, to prevent positional deviation between the thin plates, the adjacent thin plates may be partially connected to each other.

The counterforce applying mechanism 5 supports a portion of the backup plate 4 from below, the portion being located between the pair of shoulder portions 11 and 12. The counterforce applying mechanism 5 applies upward counterforce to the rear surface of the backup plate 4.

As one example, the counterforce applying mechanism 5 includes a spring 21 arranged between the lower die elements 15 and 16. As one example, the spring 21 is a coil spring, and an expansion/contraction direction of the spring 21 is an upper-lower direction. A lower end of the spring 21 is supported by the base plate 14 so as to be located between the vertical portions 15*b* and 16*b* of the lower die elements 15 and 16 and is supported by a floor surface of a work space together with the lower die elements 15 and 16. In the present embodiment, a plate 22 is attached to an upper end of the spring 21. However, the plate 22 is optional. For example, when the backup plate 4 is in a no-load state, the upper end of the spring 21 may be in direct contact with the rear surface of the backup plate 4, or the upper end of the spring 21 and the rear surface of the backup plate 4 may be separated from each other without contacting each other.

As another example, the counterforce applying mechanism 5 may be a gas cylinder arranged such that a direction in which the counterforce is generated is the upper-lower direction. In this case, the plate 22 is attached to a tip of a portion of the gas cylinder which portion generates the counterforce with respect to the backup plate 4. However, the plate 22 is optional.

As described below, the counterforce applying mechanism 5 is preferably used when, for example, the punch 6 presses an edge portion of the workpiece 90 which has a large thickness and requires large forming force, that is to say, pressing force of the punch 6. Therefore, the counterforce applying mechanism 5 may not be used when pressing a non-edge portion, that is to say, an intermediate portion, of the workpiece 90. A method of switching between when the counterforce applying mechanism 5 is used and when the counterforce applying mechanism 5 is not used is not especially limited. For example, the base plate 14 may be divided into portions supporting the lower die elements 15 and 16 and a portion supporting the spring 21, and the counterforce applying mechanism 5 may be movable in the upper-lower direction or a horizontal direction. With this, the counterforce applying mechanism 5 can be automatically switched between a use state in which the counterforce applying mechanism 5 is located between the lower die elements 15 and 16 and can be in surface contact with the rear surface of the backup plate 4 and a non-use state in which the counterforce applying mechanism 5 retracts to a lower position or a lateral position so as not to be in surface contact with the rear surface of the backup plate 4. Or, a worker may manually perform work of timely attaching or detaching the counterforce applying mechanism 5.

The punch 6 is movable relative to the die 3 in the upper-lower direction. In the present embodiment, the die 3 is fixed to the floor surface, and the punch 6 is movable relative to the floor surface in the upper-lower direction. However, the die 3 may be movable in the upper-lower direction in addition to or instead of the punch 6. The punch 6 is arranged above the die 3, the backup plate 4, and the workpiece 90. The punch 6 moves downward to press a front surface of the workpiece 90. At this time, the backup plate 4 deforms together with the workpiece 90. This deformation of the backup plate 4 is within the elastic deformation region. With this, stress is applied as intended to a portion of the workpiece 90 which portion is located right under the punch 6, and a bending shape is properly given to the workpiece 90. As described above, the press brake 1 can perform the multistage bending.

The punch driving mechanism 7 is an actuator that moves the punch 6 in the upper-lower direction. As one example, the punch driving mechanism 7 is comprised by a hydraulic cylinder arranged such that a rod thereof is directed in the upper-lower direction.

The control device 8 controls at least operation of the conveying mechanism 2 and operation of the punch driving mechanism 7. In case automatically performing the switching between when the counterforce applying mechanism 5 is used and when the counterforce applying mechanism 5 is not used, the control device 8 also controls operation of a moving mechanism 9 that moves the counterforce applying mechanism 5. The moving mechanism 9 is, in other words, a moving device 9.

Figure 3A:
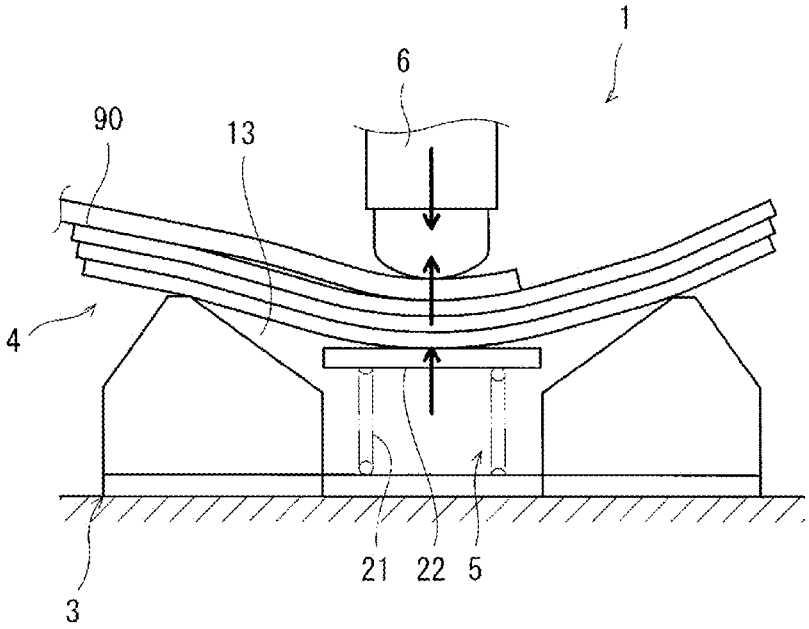
FIGS. 3A and 3B are action diagrams of the press brake according to Embodiment 1.

The action of the press brake 1 configured as above will be described with reference to FIG. 3. The following operation, or operating methods, of the conveying mechanism 2 and the punch driving mechanism 7, or the punch 6, is executed by the driving control performed by the control device 8.

In an initial state, the backup plate 4 is placed on the die 3, and the backup plate 4 is ready to receive the counterforce from the counterforce applying mechanism 5. When the conveyance of the workpiece 90 starts, and the edge portion of the workpiece 90 reaches a position that is on the backup plate 4 and right under the punch 6, the conveyance of the workpiece 90 stops. Next, the punch 6 is lowered. Then, reaction force of the backup plate 4 is transmitted to the workpiece 90 by the backup plate 4 bending in a state where the workpiece 90 is sandwiched between the punch 6 and the backup plate 4. Moreover, the counterforce generated by the counterforce applying mechanism 5 increases in accordance with the pressing of the punch 6 and is transmitted to the workpiece 90 in addition to the reaction force. With this, the large reaction force, that includes the counterforce, is obtained. To be specific, when a pressed portion of the workpiece 90 located on the backup plate 4 is the edge portion of the workpiece 90, the counterforce is applied to the edge portion by the counterforce applying mechanism 5. Therefore, the target bending angle can be accurately given to the edge portion of the workpiece 90. At this time, a large load is also applied to the punch 6.

Once the pressing of the punch 6 with respect to the workpiece 90 is terminated, the punch 6 moves upward to retract from the die 3 and the workpiece 90. Then, after such operation is performed once or is intermittently performed multiple times, the workpiece 90 is conveyed by a predetermined conveyance amount. The conveyance of the workpiece 90 stops when the non-edge portion of the workpiece 90 is supported on the backup plate 4, i.e., when the end portion of the workpiece 90 is located outside the pair of shoulder portions 11 and 12 in the conveying direction. When the conveyance of the workpiece 90 stops, the punch 6 moves downward again to press the workpiece 90. At this time, the counterforce applying mechanism 5 is in a state of retracting from the die 3. Therefore, although the reaction force can be increased by the backup plate 4, the large reaction force which is generated when bending the edge portion is not generated. To be specific, when the pressed portion of the workpiece 90 located on the backup plate 4 is the non-edge portion of the workpiece 90, the counterforce is not applied to the non-edge portion by the counterforce applying mechanism 5. With this, since the reaction force of the backup plate 4 is obtained for the non-edge portion, forming accuracy improves, and the load applied to the punch 6 is reduced. Thus, the durability of the punch 6 and the punch driving mechanism 7 are prolonged. The pressing of the punch 6 is performed within the elastic deformation region of the backup plate 4. Therefore, when the punch 6 moves upward, and the load applied to the workpiece 90 and the backup plate 4 is eliminated, the backup plate 4 returns to an original shape and takes a posture of horizontally extending on the shoulder portions, and a change in the stroke of the punch 6 due to the deformation of the backup plate 4 is not required. On this account, the press brake 1 is an apparatus which has high repeatability, which can realize the same bending angle by the same stroke every time.

The workpiece 90 is intermittently conveyed. Each time the conveyance of the workpiece 90 stops, the punch 6 presses the workpiece 90. When a terminal end of the workpiece 90 is supported on the backup plate 4, i.e., when the edge portion of the workpiece 90 exists in a region sandwiched by the pair of shoulder portions 11 and 12, the punch 6 presses the terminal end of the workpiece 90 while applying the counterforce to the backup plate 4 by the counterforce applying mechanism 5 again.

By executing the above multistage bending, the desired bending shape can be accurately given to the workpiece 90, and the load applied to the punch 6 can be reduced as much as possible.

Figure 3B:
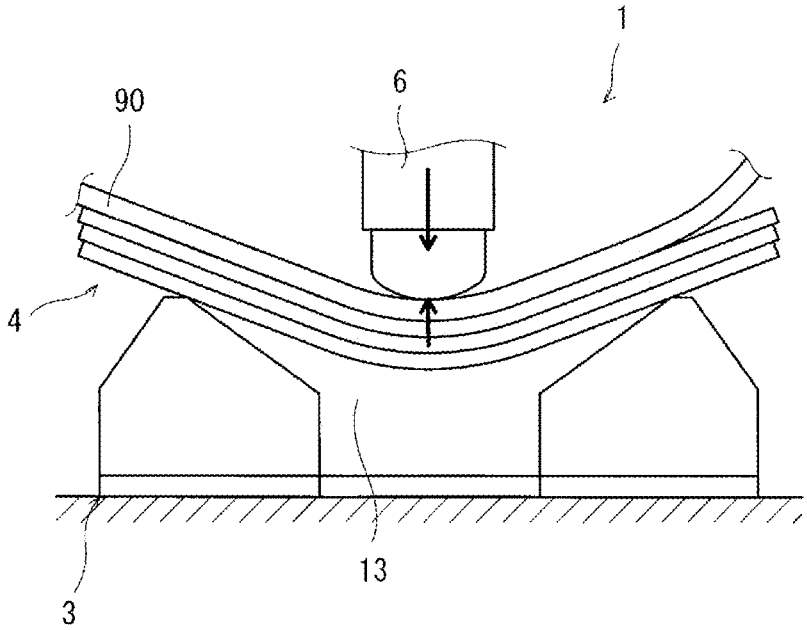

As shown in FIG. 3B, the rear surface of the workpiece 90 is supported by a surface of the backup plate 4. In addition, in the process of the deformation of the workpiece 90 pressed by the punch 6, the rear surface of the workpiece 90 is supported by the surface of the backup plate 4. To be specific, a large gap is not generated between the rear surface of the workpiece 90 and the upper surface of the backup plate 4. Therefore, for example, in case the punch 6 presses the vicinity of a portion, this is to say, a thickness step portion, of the workpiece 90 which portion has a relatively large thickness difference between upstream and downstream sides in the conveying direction, the generation of kink at this portion that changes in thickness can be suppressed, and a desired curvature can be given to the workpiece 90. To be specific, normally, in case the workpiece includes such thickness step portion, there is a possibility that stress concentrates on the level-difference portion by the pressing of the the punch 6, and because of this, the workpiece kinks at this portion. However, according to the press brake 1 of the present embodiment, as described above, the rear surface of the workpiece 90 is supported by the large surface of the backup plate 4. Therefore, the stress can be dispersed on the rear surface of the workpiece 90. Thus, the generation of the kink can be prevented even if the vicinity of the thickness step portion is pressed.

The counterforce applying mechanism 5 may be used when the punch 6 presses the non-edge portion of the workpiece 90. For example, the plate 22 at the upper end of the spring 21 is arranged downwardly away from the rear surface of the backup plate 4 by a predetermined distance. Then, in case giving a large curvature radius to the workpiece 90, small pressing force is applied to a target portion by the punch 6. In this case, the plate 22 does not contact this portion of the rear surface of the workpiece 90, and only the reaction force of the backup plate 4 is applied to the workpiece 90 from below. Thus, the bending can be performed by relatively small pressing force. On the other hand, in case giving a small curvature radius to the workpiece, large pressing force is applied to the target portion by the punch 6. In this case, the plate 22 contacts this portion of the rear surface of the workpiece 90, and the counterforce of the spring 21 is applied to the workpiece 90 in addition to the reaction force of the backup plate 4. Therefore, even if the bending process is performed with a relatively large pressing force, pressure can be appropriately applied to the rear surface of the workpiece 90.

Moreover, the spring 21 of the counterforce applying mechanism 5 may be configured such that two or more spring elements having different elastic coefficients are connected to each other in series. In this case, if the pressing force of the punch 6 with respect to the workpiece 90 is small, the spring element having a smaller elastic coefficient contracts. With this, the surface pressure applied to the rear surface of the workpiece 90 can be prevented from becoming excessive. Then, if the pressing force of the punch 6 with respect to the workpiece 90 is large, the spring element having a larger elastic coefficient supports the workpiece 90. With this, appropriate surface pressure can be applied to the rear surface of the workpiece 90. Therefore, in this case, the plate 22 may be in surface contact with the rear surface of the backup plate 4 at all times.

Embodiment 2

Figure 4:
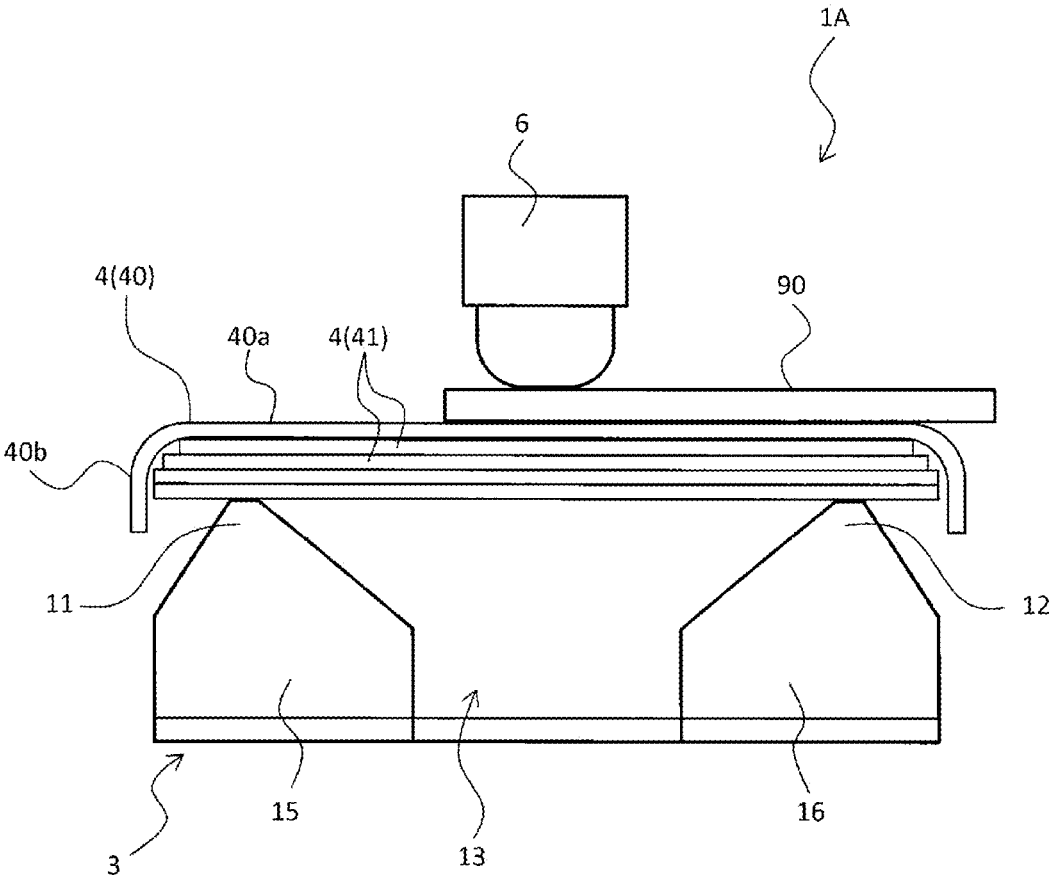
FIG. 4 is a side view of the press brake according to Embodiment 2.

FIG. 4 is a side view of a press brake 1A according to Embodiment 2. The press brake 1A according to Embodiment 2 is the same as the press brake 1 according to Embodiment 1 except that the backup plate 4 in Embodiment 2 is different in configuration from the backup plate 4 in Embodiment 1. Moreover, as with Embodiment 1, the press brake 1A described in Embodiment 2 can be operated by the control device 8 described with reference to FIG. 2.

The backup plate 4 of the press brake 1A according to Embodiment 2 includes a laminated structure in which thin plates are stacked on each other. Among the thin plates, a thin plate, hereinafter referred to as an "outer-surface plate 40", located closest to the punch 6 is different in configuration from the other thin plates, hereinafter referred to as "inner plates 41". More specifically, each of the inner plates 41 is comprised by an entirely flat plate shape. On the other hand, the outer-surface plate 40 includes a flat plate portion 40*a* and a curved portion 40*b*. The flat plate portion 40*a* has a flat plate shape that is substantially the same in area as the inner plate 41. The curved portion 40*b* is such a curved portion that both edge portions of the outer-surface plate 40 in the conveying direction curve in a direction away from the punch 6. Then, edge portions of the inner plates 41 in the conveying direction are covered with the curved portion 40*b*.

According to this configuration, the positional deviation of the inner plates 41, located under the curved portion 40*b*, in the conveying direction can be prevented by the curved portion 40*b* of the outer-surface plate 40. Moreover, since the edge portions of the inner plates 41 in the conveying direction are not exposed, the generation of scratches on the rear surface of the workpiece 90 by the contact with the edge portions can be prevented.

According to the above configuration, at the time of the pressing, reaction force is applied to the workpiece from the backup plate which elastically deforms in accordance with the bending of the workpiece. Therefore, the same forming accuracy as in case the forming is performed by bringing the workpiece into contact with the bottom of the die can be obtained, and in addition, even the edge portion of a material can be bent. On the other hand, as with the partial bending method, the bending shape given to the workpiece can be controlled in accordance with the pressing amount. Thus, the forming can be freely performed regardless of the thickness, and the forming accuracy improves.

According to the present disclosure, forming accuracy can be improved.

The functionality of the elements disclosed herein may be implemented using circuitry or processing circuitry which includes general purpose processors, special purpose processors, integrated circuits, ASICs ("Application Specific Integrated Circuits"), conventional circuitry and/or combinations thereof which are configured or programmed to perform the disclosed functionality. Processors are considered processing circuitry or circuitry as they include transistors and other circuitry therein. The processor may be a programmed processor which executes a program stored in a memory. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The foregoing has described the embodiments of the present disclosure. Additions, modifications, and/or eliminations may be suitably made with respect to the above configurations within the scope of the present disclosure.

What is claimed is:

1. A press brake that performs bending with respect to a workpiece by a die and a punch, the press brake comprising:

a die including a pair of shoulder portions and a groove portion located between the pair of shoulder portions, the pair of shoulder portions being arranged away from each other in a conveying direction of a workpiece and supporting a rear surface of the workpiece;

a backup plate that extends on the pair of shoulder portions, covers the groove portion, and is interposed between the die and the workpiece; and a punch that moves relative to the die and presses the workpiece within an elastic deformation region of the backup plate to bend the workpiece, wherein the backup plate includes a laminated structure in which plates are stacked on each other, and among the plates included in the backup plate, an outer-surface plate that is a plate located closest to the punch includes a curved portion that both edge portions of the outer-surface plate in the conveying direction of the workpiece curve in a direction away from the punch, and both edge portions extend past all of the plates of the backup plate, and the curved portion covers edge portions of the plates in the conveying direction.

2. The press brake according to claim 1, further comprising a counterforce applying mechanism that, when an edge portion of the workpiece is positioned on the backup plate, applies counterforce to the backup plate, the counterforce acting in a direction opposite to a pressing direction of the punch.

3. A method of operating a press brake, the press brake including:

a conveying mechanism that conveys a workpiece;

a die including a pair of shoulder portions and a groove portion located between the pair of shoulder portions, the pair of shoulder portions being arranged away from each other in a conveying direction of the workpiece and supporting a rear surface of the workpiece;

a backup plate that extends on the pair of shoulder portions, covers the groove portion, and is interposed between the die and the workpiece; and a punch that moves relative to the die and presses the workpiece, wherein the backup plate includes a laminated structure in which plates are stacked on each other, and among the plates included in the backup plate, an outer-surface plate that is a plate located closest to the punch includes a curved portion that both edge portions of the outer-surface plate in the conveying direction of the workpiece curve in a direction away from the punch, and both edge portions extend past all of the plates of the backup plate, and the curved portion covers edge portions of the plates in the conveying direction, the method comprising:

conveying the workpiece and stopping conveying the workpiece at a position on the backup plate and right under the punch; and moving the punch relative to the die and pressing the workpiece within an elastic deformation region of the backup plate.

4. The method according to claim 3, wherein the press brake further includes a counterforce applying mechanism that applies counterforce to the backup plate, the counterforce acting in a direction opposite to a pressing direction of the punch, the method further comprising:

when a pressed portion of the workpiece located on the backup plate is an edge portion of the workpiece, arranging the counterforce applying mechanism; and when the pressed portion of the workpiece located on the backup plate is a non-edge portion of the workpiece, retracting the counterforce applying mechanism.

* * * * *